United States Patent [19]

Sheu

[11] Patent Number: 4,682,696

[45] Date of Patent: Jul. 28, 1987

[54] ADJUSTABLE BOOKRACK

[76] Inventor: Muh-Chuan Sheu, No. 642, Chung-Cheng Road, I-Chia Village, Jen-Teh Hsiang, Tainan Hsien, Taiwan

[21] Appl. No.: 844,789

[22] Filed: Mar. 27, 1986

[51] Int. Cl.[4] ..... A47B 65/00

[52] U.S. Cl. ..... 211/43; 248/297.2

[58] Field of Search ..... 211/43, 42, 59.3, 184; 248/DIG. 16, 441.1, 316.4, 297.2

[56] References Cited

U.S. PATENT DOCUMENTS

| | | | |
|---|---|---|---|
| 525,186 | 8/1894 | Bowley | 211/43 X |
| 670,446 | 3/1901 | Fletcher et al. | 211/43 X |
| 1,237,101 | 8/1917 | Ryan | 211/43 |
| 2,140,656 | 12/1938 | Smith | 211/43 |
| 2,222,190 | 11/1940 | Wolf | 211/43 X |
| 2,940,718 | 6/1960 | Beal | 248/297.2 X |
| 3,048,851 | 8/1962 | Bickford | 248/297.2 X |
| 4,278,224 | 7/1981 | Arakawa | 248/297.2 X |

FOREIGN PATENT DOCUMENTS

| | | | |
|---|---|---|---|
| 28617 | 11/1910 | Fed. Rep. of Germany | 211/43 |
| 611044 | 9/1926 | France | 211/43 |
| 0044931 | 4/1979 | Japan | 211/42 |
| 176990 | 1/1922 | United Kingdom | 211/42 |

*Primary Examiner*—Reinaldo P. Machado
*Assistant Examiner*—Sarah A. Lechok Eley
*Attorney, Agent, or Firm*—Ladas & Parry

[57] ABSTRACT

An adjustable bookrack includes a base with a guideway provided in an upper surface thereof, the guideway having a first frictional surface; a stationary upright end wall mounted securely at one end of base; a movable upright end wall disposed detachably on the guideway; a gliding member secured to the underside of the moveable upright end wall and slidable on the guideway; a braking member releasably disposed under the gliding member and having a second frictional surface opposing the first frictional surface; and means for biasing the braking member toward the gliding member so as to impel the second frictional surface against the first frictional surface, including an actuator member. Thereby, when the actuator member is pushed, the braking member is released from the guideway so as to adjust the space between the stationary and movable upright end wall.

4 Claims, 6 Drawing Figures

ADJUSTABLE BOOKRACK

BACKGROUND OF THE INVENTION

The invention relates to a bookrack, particularly to an adjustable bookrack, having an integrated structure and in which the space between the two end walls is adjustable.

Conventionally, there are two known types of bookracks available for study and office use. One is an adjustable type. This kind of bookrack has two portions, each including respectively a base and an end wall secured to the base, so that the space between the end walls can be adjusted to hold all the books tightly. However, this type is unsightly. The other is a stationary type, consisting of a base and two end walls secured to the ends of the base so that the space between the two end walls can't be adjusted. Althrough this is more attractive than the adjustable type, this kind of bookrack also has the drawback that when there are too few books to pack between the two end walls of the bookrack, the books can't be held up well by the two end walls.

SUMMARY OF THE INVENTION

An object of the invention is to provide an attractive bookrack of which the space between the two end walls is adjustable.

According to the invention, an adjustable bookrack includes a base including a guide way provided in the upper surface thereof, said guide way having a first frictional surface; a stationary upright end wall mounted securely at one end of said base; a moveable upright end wall disposed detachably on said guide way of said base; a gliding member secured to the underside of said movable upright end wall and slidable on said guide way, having a chamber provided therein; a braking member releasably disposed under said gliding member, having a second frictional surface opposing said first frictional surface; and means for biasing said braking member toward said gliding member so as to impel said second frictional surface against said first frictional surface, including a compression spring disposed within said chamber, an actuator member passing through said compression spring and said chamber to form a handle extending out of said chamber at upper end thereof, and a stop member secured to said actuator member above said spring within said chamber for obstructing said compression spring. Said actuator member engages said braking member at the lower end of the former.

BRIEF DESCRIPTION OF THE DRAWING

Further characteristic features and advantages will emerge more clearly from a detailed description of the invention, given by way of a non-limiting example with reference to the attached drawings in which.

DETAILED DESCRIPTION OF THE PREFERRED EMBODIMENT

Figure 1:
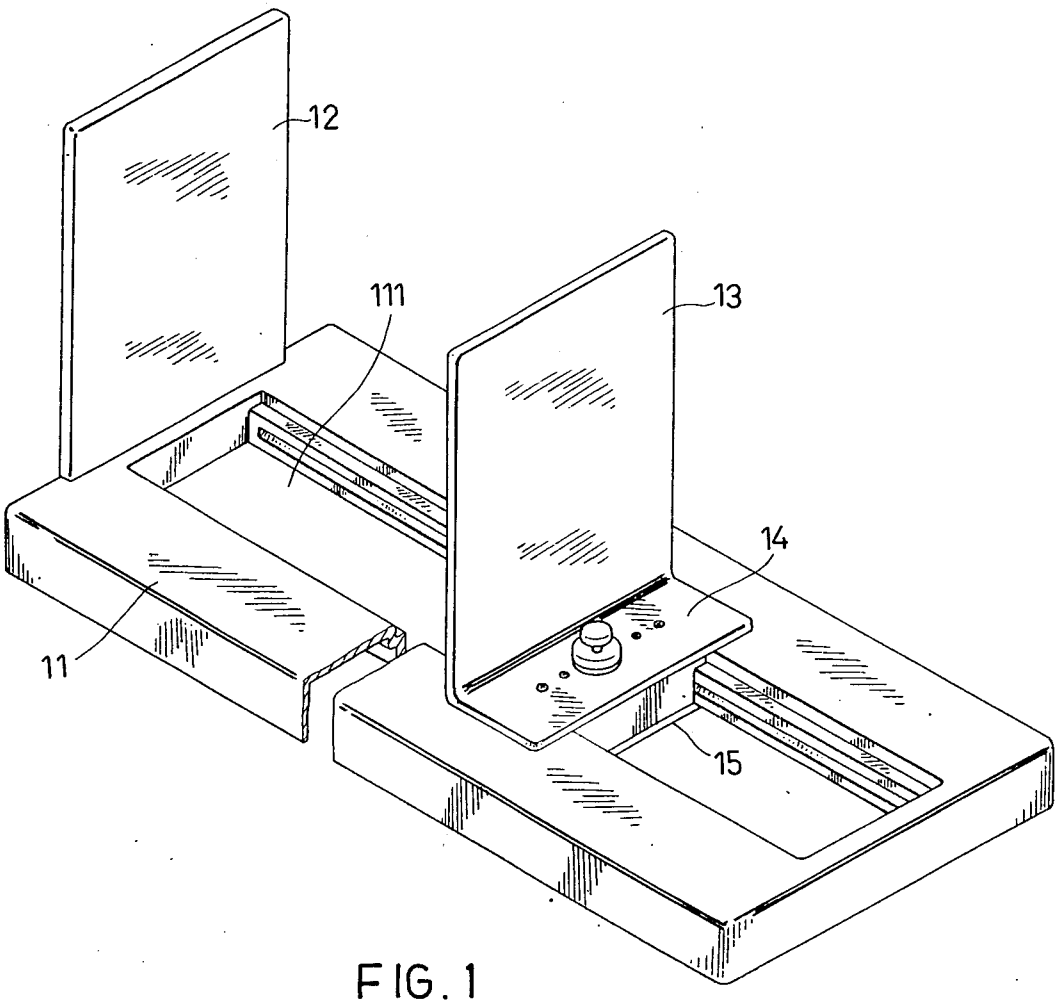
FIG. 1 is a perspective view showing a bookrack according to the invention.
Figure 2:
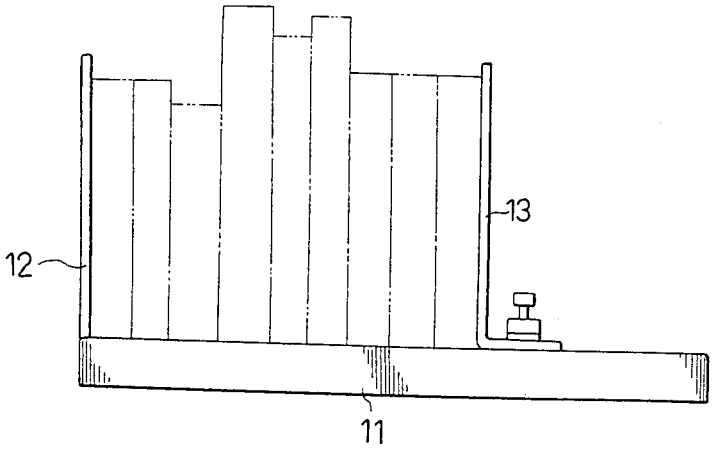
FIG. 2 is a schematic elevational view showing a bookrack according to the invention in use.

Referring to FIGS. 1 and 2, there is shown a base 11, a stationary upright end wall 12 secured to one end of the base 11, a movable upright end wall 13, a gliding member 14 bolted securely to underside of the movable upright end wall 13 and a braking member 15 disposed under the gliding member 14.

Figure 3:
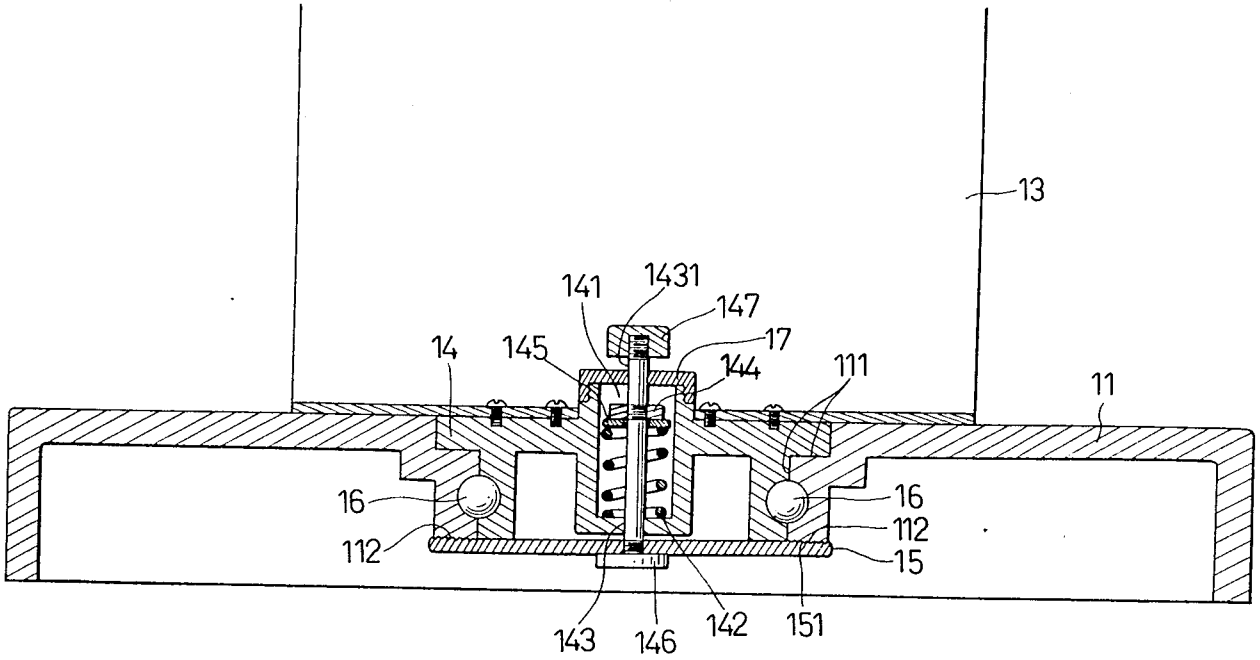
FIG. 3 is a partial longitudinal sectional view showing a bookrack according to the invention.

Referring to FIG. 3, the base 11 recedes downward from its upper surface to form a guideway 111. Also, the gliding member 14 has a chamber 141. There is means for biasing the braking member 15 toward the gliding member 14, the biasing means including a compression spring 142 disposed within the chamber 141, an actuator member 143 passing through the compression spring 142 and the chamber 141 to form a handle 1431 extending out of the chamber 141, a first stop member 144 screwed to the actuator member 143 above the compression spring 142 within the chamber 141, a washer 145 interposed between the first stop member 144 and the compression spring 142, a second stop member 146 screwed to the lower end of the actuator member 143 to raise the braking member 15, and push button 147 screwed to the upper end of the actuator member 143.

In the combination of the biasing means, after the actuator member 143, first stop member 144, washer 145 and compression spring 142 have been fitted into the chamber 141 and fixed at suitable positions, an upper cap 17 will be screwed to the gliding member 14 so as to cover the chamber 141.

Additionally, in order so that the movable upright end wall 13 together with the gliding member 14 is stably fixed on the guideway 111, the guideway 111 has a first knurled surface 112 and the braking member 15 has a second knurled surface 151 opposite the first knurled surface 112, so that the friction between the first and second knurled surfaces 112, 151 increases after ther are engaged by the biasing means.

Figure 5:
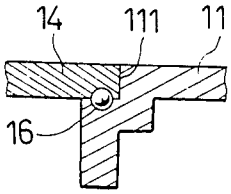
FIG. 5 is a schematic sectional view showing a roller interposed between the gliding member and the guideway of the base for the purpose of facilitating the sliding motion thereof.
Figure 6:
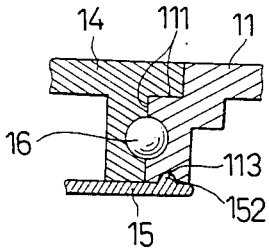
FIG. 6 is a schematic sectional view showing a joint between the gliding member and the guideway of the base in the form of a tongue and groove.

Furthermore, in order to facilitate the sliding motion of gliding member 14, at least one rolling element, such as roller 16 shown in FIG. 3, 5 and 6, may be provided at any suitable position between the guideway 111 and the gliding member 14. The roller 16 may be inserted into the guideway 111 and/or the gliding member 14.

Figure 4:
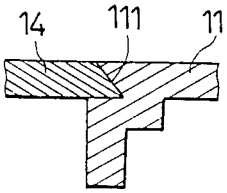
FIG. 4 is a schematic sectional view showing a joint between a gliding member and a guideway of a base in the form of a dovetail.

In addition to facilitate the smooth guiding of the gliding member 14, the gliding member 14 may be jointed with the guideway 111 in any suitable manner, e.g. in a dovetail joint, as shown in FIG. 4.

In operation, when the actuator member 143 is moved downward against the biasing force of the compression spring 142 by depressing the push button 147, the braking member 15 will be moved downward, disengaging with the guideway 111, so that the gliding member 14 may be moved back and forth in the guideway 111. After the position of the gliding member 14 has been adjusted, the pressure exerted on the button 147 may be released so that the compression spring 142 biases the braking member 15 toward the gliding member 14, fixing the movable upright end wall 13 at a suitable position of the guideway 111.

As shown in FIG. 6, it is known in the art for braking member 16 to be provided with a tongue 152 and for the guide way 11 to be provided with a plurality of grooves 113 along a equipotential line so as to set the movable upright end wall 13 at any one of many predetermined positions. Certainly, the joint of the tongue and groove may be also provided between the gliding member 14 and the guideway 111.

It is noted that the stationary upright end wall 12 may be in the form of a movable upright end wall, to allow further adjustment of the space between the two end walls of the bookrack.

With the invention thus explained, it is apparent that various modifications and variations can be made without departing from the scope of the invention. It is therefore intended that the invention be limited as indicated in the appended claims.

What is claimed is:

1. An adjustable bookrack comprising:

a base including a guideway provided in an upper surface thereof, said guideway having a first frictional surface;

a stationary upright end wall mounted securely at one end of said base;

a movable upright end wall disposed detachably on said guideway of said base;

a gliding member secured to the underside of said movable upright end wall and slidable on said guideway of said base, said gliding member having a chamber;

a braking member releasably disposed under said gliding member, having a second frictional surface opposing said first frictional surface;

means for biasing said braking member toward said gliding member so as to impel said second frictional surface against said first frictional surface;

said biasing means comprising a compression spring disposed within said chamber, an actuator member passing through said compression spring and said chamber to form a handle extending out of said chamber at an upper end thereof, and a stop member secured to said actuator above said compression spring within said chamber for obstructing said spring, said actuator member engaging with said braking member at a lower end; and at least one rolling element interposed between said guideway of said base and said gliding member so as to reduce the friction therebetween.

2. An adjustable bookrack as claimed in claim 1, further comprising a push button secured to said handle of said actuator member.

3. An adjustable bookrack as claimed in claim 1, wherein said rolling element is a roller.

4. An adjustable bookrack as claimed in claim 1, wherein said first and second frictional surface are knurled.

* * * * *